US007850744B2

(12) United States Patent
Voelkel et al.

(10) Patent No.: US 7,850,744 B2
(45) Date of Patent: Dec. 14, 2010

(54) HETEROCYCLIC COMPOUNDS CONTAINING NITROGEN AS A FUEL ADDITIVE IN ORDER TO REDUCE ABRASION

(75) Inventors: Ludwig Voelkel, Limburgerhof (DE); Arno Lange, Bad Duerkheim (DE); Christian Lockemann, Mannheim (DE); Dietmar Posselt, Heidelberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 352 days.

(21) Appl. No.: 11/573,068

(22) PCT Filed: Aug. 4, 2005

(86) PCT No.: PCT/EP2005/008468

§ 371 (c)(1), (2), (4) Date: Oct. 5, 2007

(87) PCT Pub. No.: WO2006/015800

PCT Pub. Date: Feb. 16, 2006

(65) Prior Publication Data

US 2008/0190014 A1 Aug. 14, 2008

(30) Foreign Application Priority Data

Aug. 5, 2004 (DE) ..... 10 2004 038 113

(51) Int. Cl.
*C10L 1/232* (2006.01)

(52) U.S. Cl. ..... 44/343

(58) Field of Classification Search ..... 44/344, 44/329, 343; 508/280
See application file for complete search history.

(56) References Cited

U.S. PATENT DOCUMENTS

| | | | | |
|---|---|---|---|---|
| 3,223,496 | A * | 12/1965 | Schoen | 44/343 |
| 3,511,623 | A * | 5/1970 | Patinkin | 44/340 |
| 3,843,337 | A * | 10/1974 | Korpics | 44/343 |
| 4,060,491 | A | 11/1977 | Bridger et al. | |
| 4,849,572 | A | 7/1989 | Chen et al. | |
| 4,877,416 | A | 10/1989 | Campbell | |
| 4,959,077 | A | 9/1990 | Martischius et al. | |
| 5,004,478 | A | 4/1991 | Vogel et al. | |
| 5,112,364 | A | 5/1992 | Rath et al. | |
| 5,298,039 | A | 3/1994 | Mohr et al. | |
| 5,482,521 | A * | 1/1996 | Avery et al. | 44/344 |
| 5,505,867 | A | 4/1996 | Ritter | |
| 5,538,653 | A | 7/1996 | Avery et al. | |
| 5,660,601 | A | 8/1997 | Oppenländer et al. | |
| 5,730,762 | A * | 3/1998 | Murakami et al. | 44/329 |
| 5,746,786 | A | 5/1998 | Mueller et al. | |
| 5,756,435 | A | 5/1998 | Carey et al. | |
| 5,879,420 | A | 3/1999 | Kropp et al. | |
| 5,972,856 | A | 10/1999 | Kropp et al. | |
| 5,980,594 | A | 11/1999 | Kropp et al. | |
| 6,069,281 | A | 5/2000 | Kropp et al. | |
| 6,140,541 | A | 10/2000 | Melder et al. | |
| 6,267,791 | B1 | 7/2001 | Thomas et al. | |
| 2004/0007507 | A1 | 1/2004 | Smith | |
| 2006/0019840 | A1 * | 1/2006 | Kawahara et al. | 508/280 |

FOREIGN PATENT DOCUMENTS

| | | | |
|---|---|---|---|
| CA | 2 050 967 | | 3/1992 |
| CA | 2 112 732 | | 7/1994 |
| CA | 2 391 932 | A1 | 5/2001 |
| DE | 38 26 608 | A1 | 2/1990 |
| DE | 383 89 18 | A1 | 5/1990 |
| DE | 41 42 241 | A1 | 6/1993 |
| DE | 43 09 074 | A1 | 9/1994 |
| DE | 196 20 262 | A1 | 11/1997 |
| DE | 101 02 913 | A1 | 7/2002 |
| EP | 0 310 875 | A1 | 4/1989 |
| EP | 0 307 815 | B1 | 4/1992 |
| EP | 0 476 485 | B1 | 5/1994 |
| EP | 0 548 617 | B1 | 3/1996 |
| EP | 0 639 632 | B1 | 4/1996 |
| EP | 0 605 857 | B1 | 11/1996 |
| EP | 0 829 527 | A1 | 3/1998 |
| EP | 0 831 141 | A1 | 3/1998 |
| EP | 0 869 163 | A1 | 10/1998 |
| EP | 0 356 725 | B2 | 2/1999 |
| EP | 0 700 985 | B1 | 3/1999 |
| EP | 0 452 328 | B2 | 6/1999 |

(Continued)

OTHER PUBLICATIONS

M. Rossenbeck, et al. "Katalysatoren, Tenside, Mieralöladditive, Catalysts, Surfactants, Mineral Oil additives, eds.", 1978, 2 cover pages, pp. 223-229.

(Continued)

*Primary Examiner*—Ellen M McAvoy
*Assistant Examiner*—Chantel Graham
(74) *Attorney, Agent, or Firm*—Oblon, Spivak, McClelland, Maier & Neustadt, L.L.P.

(57) ABSTRACT

The present invention relates to the use of at least one heterocyclic compound of the formula (I)

(I)

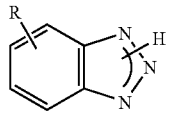

in which R is H or $C_1$-$C_3$-alkyl
as a frictional wear-reducing additive in fuel compositions; to corresponding additized fuel compositions and their preparation; and to additive concentrates which comprise such compounds.

15 Claims, No Drawings

FOREIGN PATENT DOCUMENTS

| | | | |
|---|---|---|---|
| EP | 0 780 460 | B1 | 6/2001 |
| EP | 1 246 895 | B1 | 10/2003 |
| EP | 1 230 328 | B1 | 10/2004 |
| GB | 1 457 204 | | 12/1976 |
| GB | 2 071 139 | A | 9/1981 |
| WO | WO 87/01126 | | 2/1987 |
| WO | WO 94/24231 | | 10/1994 |
| WO | WO 96/03367 | | 2/1996 |
| WO | WO 97/03946 | | 2/1997 |
| WO | WO 97/45507 | | 12/1997 |
| WO | WO 98/30658 | | 7/1998 |
| WO | WO 96/03479 | A1 | 2/2006 |

OTHER PUBLICATIONS

David Margaroni "Fuel Lubricity", Industrial Lubrication and Tribology, vol. 50. No. 3, May/Jun. 1998, pp. 108-118.

Wei Dan Ping, et al. "Comparison of the Lubricity of gasoline and Diesel Fuels" Society of Automotive Engineers, Inc., Paper 962010, pp. 51-59.

* cited by examiner

HETEROCYCLIC COMPOUNDS CONTAINING NITROGEN AS A FUEL ADDITIVE IN ORDER TO REDUCE ABRASION

This application is a 371 of PCT/EP05/08468 filed Aug. 4, 2005.

The present invention relates to the use of at least one heterocyclic compound of the formula (I)

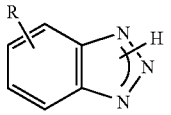

(I)

in which R is H or $C_1$-$C_3$-alkyl as a frictional wear-reducing additive in fuel compositions; to correspondingly additized fuel compositions and their preparation; and to additive concentrates which comprise such compounds.

STATE OF THE ART

Carburetors and intake systems of spark-ignition engines, but also injection systems for fuel metering, are severely contaminated by impurities which are caused by dust particles from the air, uncombusted hydrocarbon residues from the combustion chamber and the crankcase vent gases conducted into the carburetor. These residues shift the air-fuel ratio when idling and in the lower partial load range, so that the mixture becomes leaner, the combustion becomes more incomplete and hence the proportions of uncombusted or partly combusted hydrocarbons in the exhaust gas become higher. Increasing gasoline consumption is the consequence.

It is known that these disadvantages can be avoided by using fuel additives to keep valves and carburetors or injection systems of spark-ignition engines clean (cf., for example: M. Rossenbeck in Katalysatoren, Tenside, Mineralöladditive [Catalysts, Surfactants, Mineral oil additives], eds, J. Falbe, U. Hasserodt, p. 223, G. Thieme Verlag, Stuttgart, 1973). Such interface-active fuel additives are generally referred to as "detergents". In the field of lubricant compositions, what are known as "dispersants" are often used as interface-active additives, and some of these are also suitable for use as detergents in fuel compositions.

Such detergents, which can stem from a multitude of chemical substance classes, for example polyalkeneamines, polyetheramines, polybutene-Mannich bases or polybutenesuccinimides, are employed generally in combination with carrier oils and if appropriate further additive components, for example corrosion inhibitors and demulsifiers. Gasoline fuels with and without such gasoline fuel additives show a different performance with regard to their lubricity and wear properties in spark-ignition engines, which is, however, not satisfactory and should hence be improved.

In contrast to fuel additives for diesel fuels, for which components for improving the lubricity of diesel fuels already form part of the prior art, there are only a few technical solutions on the part of the gasoline fuels for significantly increasing the lubricity of gasoline fuels by the addition of suitable additives and hence improving them. For example, it is known that fatty acids and derivatives thereof (EP-A-780 460, EP-A-829 527), alkenylsuccinic esters (WO 97/45507), bis(hydroxyalkyl) fatty amines (EP-A-869 163) or hydroxyacetamides (WO-98/30658, U.S. Pat. No. 5,756,435) can improve the lubricity of gasoline fuels as additives to gasoline fuels and/or gasoline fuel additives. It is also known in the case of castor oil that its addition to diesel fuels (EP-A-605 857) and/or gasoline fuels (U.S. Pat. No. 5,505,867) can increase the lubricity.

EP-A-1 230 328 to BASF AG discloses synergistically active additive mixtures which can be used as lubricity improvers in fuels and lubricants and comprise the reaction product of a dicarboxylic acid or a dicarboxylic acid derivative with a long-chain, aliphatic amine and also a fatty acid ester or a component comprising a fatty acid ester, for example a vegetable oil.

U.S. Pat. No. 4,060,491 discloses the use of 5-alkylbenzotriazoles in which the alkyl radical has from 4 to 16 carbon atoms as a frictional wear-reducing additive in lubricant compositions. Use in fuel compositions, in particular in gasoline fuels, is not described. Even in the case of additization in the region of 1000 ppm (0.1% by weight), benzotriazole and tolutriazole did not exhibit satisfactory performance in the lubricants.

EP-A-1 246 895 describes further polycyclic aromatic compounds which have at least one heteroatom, selected from oxygen and nitrogen, which is present in the heterocyclic or in an exocyclic group, and bear at least one $C_1$-$C_4$ alkyl substituent on the ring. These compounds are suitable in particular as lubricity additives in diesel fuels. According to the teaching there, the alkyl substituent must not be bonded to the molecule either in the α- or in the β-position to a ring heteroatom, since insufficient lubricity is otherwise observed. Preferred examples comprise compounds having at least two heteroatoms, in particular 5-methylbenzimidazole, 2-hydroxy-4-methylquinoline, 8-hydroxyquinaldine and 4-aminoquinaldine. In addition, satisfactory results are only obtained at a dosage of above 50 ppm, preferably at about 150 ppm. The usability of compounds having more than two heteroatoms, and hence more polar compounds, for example tolutriazoles and related compounds, as a friction modifier for gasoline fuels is neither proposed explicitly in this citation nor made obvious to the expert reader in any form whatsoever.

It is therefore an object of the invention to provide novel fuel additives which improve the lubricity, in particular of gasoline fuels, and/or the wear resistance, in particular of spark-ignition engines.

BRIEF DESCRIPTION OF THE INVENTION

It has now been found that, surprisingly, the above object is achieved by use of tolutriazole and structurally related compounds as friction modifiers. It has been found that, surprisingly, even small amounts of this additive lead to a significant improvement in the frictional wear properties of the additized fuel.

This also has the advantage that compounds of the tolutriazole type, which are already used as a nonferrous metal corrosion protectant in fuels (generally in amounts of less than 10 ppm), are provided with a further use, and the possibility thus exists of improving corrosion protection and lubricity with one and the same additive.

DETAILED DESCRIPTION OF THE INVENTION

A) Preferred Embodiments

Firstly, the invention relates to the use of at least one heterocyclic compound of the formula (I)

(I)

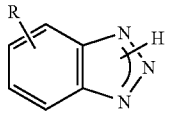

in which R is H or $C_1$-$C_3$-alkyl, for example methyl, n-propyl or isopropyl, as a frictional wear-reducing additive in fuel compositions.

Preference is given to adding the compound of the formula (I) to the fuel in a proportion of less than 1000 mg/kg, for example in a proportion of from 1 to 500 mg/kg or from 10 to 250 or from 10 to 100 mg/kg, or in a proportion of from 1 to <50 mg/kg for example from 1 to 45 mg/kg.

Preference is given to using the compound of the formula (I) in the form of a mixture of compounds which are positional isomers with regard to the ring substituent R. For instance, the compound of the formula (I) used may in particular be an isomer mixture of compounds of the formulae (Ia) and (Ib)

(Ia)

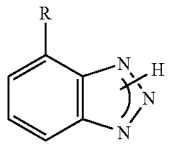

(Ib)

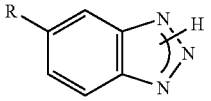

where the molar ratio of (Ia) (4-alkyl compound) to (Ib) (5-alkyl compound) is in a range from 10 to 60:90 to 40, for example at about 20 to 40:80 to 60 or at about 30 to 40:70 to 60.

The relative proportion of (Ib) is preferably greater than that of (Ia) and is from about 50 to 90 mol %, for example from 55 to 80 mol %, based on the mixture of (Ib) and (Ia).

The invention comprises all possible tautomeric forms of compounds of the formula I, Ia and Ib, individually or in a mixture. For example, the following tautomeric forms can be specified for formula I:

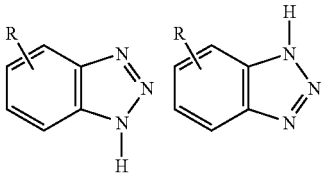

In a particularly preferred embodiment, R is methyl. In this case, the proportion of (Ib) is about 63 mol % and the proportion of (Ia) about 37 mol %.

Preference is further given to using the inventive friction modifiers in combination with at least one further conventional fuel additive, for example selected from detergent additives, carrier oils, corrosion inhibitors and mixtures comprising one or more of these additives.

In the case of the inventive use, a reduction in the frictional wear value (R; in μm) is surprisingly observed, determined as described in the following experimental part, by about 5 to 70%, for example from 5 to 60%, from 5 to 50%, from 10 to 60%, from 10 to 50%, from 15 to 60% or from 15 to 50%, in comparison to the value determined before addition of the additive of the formula (I). The determination method is based on the HFRR test used customarily in the diesel fuel sector (corresponding to CEC F-06-A-96), except that the measurement is effected at room temperature (25° C.) and under a load of 720 g (approximately 7.06 N). The fuels to be investigated are concentrated distillatively to 50% by volume before the measurement.

In an alternative embodiment, the invention relates to the use of the above heterocycles in combination with at least one further conventional friction-reducing additive known from the prior art (cf., for example, above).

The invention further provides fuel compositions comprising, in a majority of a customary base fuel, a frictional wear-reducing amount of a heterocyclic compound of the formula (I) as defined above.

The invention also provides additive concentrates comprising at least one friction-reducing additive as defined above in combination with at least one further customary fuel additive and, if appropriate, at least one further customary friction-reducing additive.

Particular preference is given to using the above-described friction modifiers in gasoline fuels.

Finally, the invention relates to a process for preparing a fuel composition having improved frictional wear performance, wherein an effective amount of a heterocyclic compound as defined above or an additive concentrate as defined above is added to a commercial fuel composition.

B) Further Additive Components

The inventive friction modifier formulations may be added to the fuels to be additized individually or in a mixture with further effective additive components (coadditives).

B1) Detergent Additives

Examples include additives having detergent action and/or having valve seat wear-inhibiting action (hereinafter referred to as detergent additives). This detergent additive has at least one hydrophobic hydrocarbon radical having a number-average molecular weight (Mn) of from 85 to 20 000 and at least one polar moiety selected from:

(a) mono- or polyamino groups having up to 6 nitrogen atoms, of which at least one nitrogen atom has basic properties;

(b) nitro groups, if appropriate in combination with hydroxyl groups;

(c) hydroxyl groups in combination with mono- or polyamino groups, in which at least one nitrogen atom has basic properties;

(d) carboxyl groups or their alkali metal or their alkaline earth metal salts;

(e) sulfonic acid groups or their alkali metal or alkaline earth metal salts;

(f) polyoxy-$C_2$— to —$C_4$-alkylene groups which are terminated by hydroxyl groups, mono- or polyamino groups, in which at least one nitrogen atom has basic properties, or by carbamate groups;

(g) carboxylic ester groups;

(h) moieties derived from succinic anhydride and having hydroxyl and/or amino and/or amido and/or imido groups; and/or (i) moieties obtained by Mannich reaction of substituted phenols with aldehydes and mono- or polyamines.

The hydrophobic hydrocarbon radical in the above detergent additives, which ensures the adequate solubility in the fuel, has a number-average molecular weight (Mn) of from 85 to 20 000, especially from 113 to 10 000, in particular from 300 to 5000. Typical hydrophobic hydrocarbon radicals, especially in conjunction with the polar moieties (a), (c), (h) and (i), include the polypropenyl, polybutenyl and polyisobutenyl radical each having Mn=from 300 to 5000, especially from 500 to 2500, in particular from 700 to 2300.

Examples of the above groups of detergent additives include the following:

Additives comprising mono- or polyamino groups (a) are preferably polyalkenemono- or polyalkenepolyamines based on polypropene or conventional (i.e. having predominantly internal double bonds) polybutene or polyisobutene having Mn=from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, mono-amines or polyamines, such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (a) are the hydrogenation products of the reaction products of polyisobutenes having an average degree of polymerization P=from 5 to 100 with nitrogen oxides or mixtures of nitrogen oxides and oxygen, as described in particular in WO-A-97/03946.

Further preferred additives comprising monoamino groups (a) are the compounds obtainable from polyisobutene epoxides by reaction with amines and subsequent dehydration and reduction of the amino alcohols, as described in particular in DE-A-196 20 262.

Additives comprising nitro groups (b) if appropriate in combination with hydroxyl groups, are preferably reaction products of polyisobutenes having an average degree of polymerization P=from 5 to 100 or from 10 to 100 with nitrogen oxides or mixtures of nitrogen oxides and oxygen, as described in particular in WO-A-96/03367 and WO-A-96/03479. These reaction products are generally mixtures of pure nitropolyisobutenes (e.g. alpha beta-dinitropolyisobutene) and mixed hydroxynitropolyisobutenes (e.g. alpha-nitro-beta-hydroxypolyisobutene).

Additives comprising hydroxyl groups in combination with mono- or polyamino groups (c) are in particular reaction products of polyisobutene epoxides obtainable from polyisobutene having preferably predominantly terminal double bonds and Mn=from 300 to 5000, with ammonia or mono- or polyamines, as described in particular in EP-A-476 485.

Additives comprising carboxyl groups or their alkali metal or alkaline earth metal salts (d) are preferably copolymers of $C_2$-$C_{40}$-olefins with maleic anhydride which have a total molar mass of from 500 to 20 000 and of whose carboxyl groups some or all have been converted to the alkali metal or alkaline earth metal salts and any remainder of the carboxyl groups has been reacted with alcohols or amines. Such additives are disclosed in particular by EP-A-307 815. Such additives serve mainly to prevent valve seat wear and can, as described in WO-A-87/01126, advantageously be used in combination with customary fuel detergents such as poly(iso)buteneamines or polyetheramines.

Additives comprising sulfonic acid groups or their alkali metal or alkaline earth metal salts (e) are preferably alkali metal or alkaline earth metal salts of an alkyl sulfosuccinate, as described in particular in EP-A-639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (f) are preferably polyethers or polyetheramines which are obtainable by reaction of $C_2$- to $C_{60}$-alkanols, $C_6$- to $C_{30}$-alkanediols, mono or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyetheramines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising carboxylic ester groups (g) are preferably esters of mono-, di- or tricarboxylic acids with long-chain alkanols or polyols, in particular those having a minimum viscosity of 2 $mm^2/s$ at 100° C., as described in particular in DE-A-38 38 918. The mono-, di- or tricarboxylic acids used may be aliphatic or aromatic acids, and particularly suitable ester alcohols or ester polyols are long-chain representatives having, for example, from 6 to 24 carbon atoms. Typical representatives of the esters are adipates, phthalates, isophthalates, terephthalates and trimellitates of isooctanol, of isononanol, of isodecanol and of isotridecanol. Such products also have carrier oil properties.

Additives comprising moieties derived from succinic anhydride and having hydroxyl and/or amino and/or amido and/or imido groups (h) are preferably corresponding derivatives of polyisobutenylsuccinic anhydride which are obtainable by reacting conventional or highly reactive polyisobutene having Mn=from 300 to 5000 with maleic anhydride by a thermal route or via the chlorinated polyisobutene. Particular interest attaches to derivatives with aliphatic polyamines such as ethylenediamine, diethylenetriamine, triethylenetetramine or tetraethylenepentamine. Such gasoline fuel additives are described in particular in U.S. Pat. No. 4,849,572.

Additives comprising moieties obtained by Mannich reaction of substituted phenols with aldehydes and mono- or polyamines (i) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn=from 300 to 5000. Such "polyisobutene-Mannich bases" are described in particular in EP-A-831 141.

For a more precise definition of the gasoline fuel additives detailed individually, reference is explicitly made here to the disclosures of the abovementioned prior art documents.

B2) Carrier Oils and Further Components:

The additive formulations according to the invention may additionally be combined with still further customary components and additives. Mention should be made here primarily of carrier oils having no marked detergent action.

Suitable mineral carrier oils are the fractions obtained in crude oil processing, such as brightstock or base oils having viscosities, for example, from the SN 500-2000 class; and also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized). Likewise suitable are mixtures of abovementioned mineral carrier oils.

Examples of synthetic carrier oils which are useful in accordance with the invention are selected from: polyolefins (poly-alpha-olefins or poly(internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers having Mn=from 400 to 1800, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$ alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are explicitly incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Nonlimiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

B3) Further Coadditives

Further customary additives are corrosion inhibitors, for example based on ammonium salts of organic carboxylic acids, said salts tending to form films, or of heterocyclic aromatics for nonferrous metal corrosion protection; antioxidants or stabilizers, for example based on amines such as p-phenylenediamine, dicyclohexylamine or derivatives thereof or of phenols such as 2,4-di-tert-butylphenol or 3,5-di-tert-butyl-4-hydroxy-phenylpropionic acid; demulsifiers; antistats; metallocenes such as ferrocene; methyl-cyclopentadienylmanganese tricarbonyl; lubricity additives (other than the triazoles according to the invention) such as certain fatty acids, alkenylsuccinic esters, bis(hydroxyalkyl) fatty amines, hydroxyacetamides or castor oil; and also dyes (markers). Amines are also added, if appropriate, to lower the pH of the fuel.

The components and additives may be added to the fuel or lubricant individually or as a concentrate prepared beforehand (additive package) together with the inventive friction modifiers.

The detergent additives mentioned having the polar moieties (a) to (i) are added to the fuel typically in an amount of from 10 to 5000 ppm by weight, in particular from 50 to 1000 ppm by weight. The other components and additives mentioned are, if desired, added in amounts customary for this purpose.

C) Fuels

The additive compositions according to the invention are useful in all conventional gasoline fuels, as described, for example, in Ullmann's Encyclopedia of Industrial Chemistry 5th d. 1990, Volume A16, p. 719 ff.

For example, it is possible to use them in a gasoline fuel having an aromatics content of not more than 60% by volume, for example not more than 42% by volume or not more than 35% by volume, and/or a sulfur content of not more than 2000 ppm by weight, for example not more than 150 ppm by weight or not more than 10 ppm by weight.

The aromatics content of the gasoline fuel is, for example, from 10 to 50% by volume, for example from 30 to 42% by volume, in particular from 32 to 40% by volume or not more than 35% by volume. The sulfur content of the gasoline fuel is, for example, from 2 to 500 ppm by weight, for example from 5 to 100 ppm by weight, or not more than 10 ppm by weight.

In addition, the gasoline fuel may have, for example, an olefin content of up to 50% by volume, for example from 6 to 21% by volume, in particular from 7 to 18% by volume; a benzene content of up to 5% by volume, for example from 0.5 to 1.0% by volume, in particular from 0.6 to 0.9% by volume, and/or an oxygen content of up to 25% by volume, for example up to 10% by weight, or from 1.0 to 2.7% by weight, in particular from 1.2 to 2.0% by weight.

Examples of such gasoline fuels are in particular those which simultaneously have an aromatics content of not more than 38 or 35% by volume, an olefin content of not more than 21% by volume, a sulfur content of not more than 50 or 10 ppm by weight, a benzene content of not more than 1.0% by volume and an oxygen content of from 1.0 to 2.7% by weight.

The contents of alcohols and ethers in the gasoline fuel may vary over a wide range. Examples of typical maximum contents are 15% by volume for methanol, 65% by volume for ethanol 20% by volume for isopropanol, 15% by volume for tert-butanol, 20% by volume for isobutanol and 30% by volume for ethers having 5 or more carbon atoms in the molecule.

The summer vapor pressure of the gasoline fuel is typically not more than 70 kPa, in particular 60 kPa (each at 37° C.).

The RON of the gasoline fuel is generally from 75 to 105. A typical range for the corresponding MON is from 65 to 95.

The specifications mentioned are determined by customary methods (DIN EN 228).

The invention will now be illustrated in detail with reference to the working examples which follow:

EXPERIMENTAL SECTION

Preparation Example

Preparation of an Additive Formulation

Keropur® 3458N (commercial product of BASF, comprising polyisobutenamine Mn=1000, and also tridecanol polypropoxylate (Tridecanol 15×PO) and dimer fatty acid as a corrosion protectant) is heated to 60° C. and tolutriazole (63 mol % of 5-methyl and 37 mol % of 4-methyl compound) are added thereto with stirring in the mixing ratio which can be derived from table 1. This mixture is then stirred at 60° C. for 1 hour.

Use Examples

Determination of the Frictional Wear Values in Gasoline Fuel

To test the lubricity and the wear in gasoline fuels, a high frequency reciprocating rig (HFRR) was used (instrument from PCS Instruments, London). The test conditions were adjusted to the use of gasoline fuels (starting from the standard CEC F-06-A-96) (test temperature 25° C., loading 720 g). The applicability of this test method for gasoline fuels is demonstrated by the references D. Margaroni, Industrial Lubrication and Tribology, Vol. 50, No. 3, May/June 1998, pp. 108-118 and W. D. Ping, S. Korcek, H. Spikes, SAE Techn. Paper 962010, pp. 51-59 (1996).

The gasoline fuels (GF) (typical gasoline fuels to EN 228) used in this test were concentrated before the measurements by distillation in a gentle manner to 50% by volume. To this end, an MP 628 automatic distillation unit from Herzog, Lauda-Königshofen, Germany is used. This 50% residue serves to determine the blank value in the testing in the friction measuring unit. The further additives were added to this residue according to the examples listed below in table 1, and the frictional wear values were determined by the above-specified method. The resulting frictional wear values (R) are reported in micrometers (μm); the lower the value, the lower the friction which occurs.

TABLE 1

Frictional wear values R in gasoline fuels

| Ex. | Additive | Dosage [mg/kg] | R [μm] |
|---|---|---|---|
| 1 | Blank value | | 813 |
| 2 | Keropur 3458 N | 500 | 771 |
| 3 | Keropur 3458 N + Tolutriazole | 500 + 10 | 697 |
| 4 | Keropur 3458 N + Tolutriazole | 500 + 20 | 685 |
| 5 | Keropur 3458 N + Tolutriazole | 500 + 30 | 639 |
| 6 | Keropur 3458 N + Tolutriazole | 500 + 40 | 630 |
| 7 | Keropur 3458 N + Tolutriazole | 500 + 50 | 602 |
| 8 | Keropur 3458 N + Tolutriazole | 500 + 75 | 545 |
| 9 | Keropur 3458 N + Tolutriazole | 500 + 100 | 468 |

Surprisingly, even at dosages of 10 ppm, a significant improvement, entirely unexpected in the light of the prior art, in the frictional wear value (i.e. a decrease of R) is observed.

The invention claimed is:

1. A method comprising adding at least one heterocyclic compound of the formula (I) to a fuel, (I)

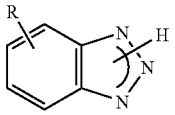

wherein R is $C_2$-$C_3$ alkyl.

2. The method according to claim 1, wherein the heterocyclic compound of the formula (I) is added to the fuel in a proportion of less than 1000 mg/kg.

3. The method according to claim 2, wherein the heterocyclic compound of the formula (I) is added to the fuel in proportion of from 1 to 500 mg/kg.

4. The method according to claim 3, wherein the heterocyclic compound of the formula (I) is added to the fuel in a proportion of from 1 to <50 mg/kg.

5. The method of claim 1, wherein the heterocyclic compound of the formula (I) is in the form of a mixture of compounds which are positional isomers with regard to the ring substituent R.

6. The method according to claim 5, wherein compound of the formula (I) comprises an isomer mixture of compounds of the formulae (Ia) and (Ib)

(Ia)

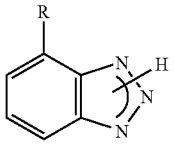

(Ib)

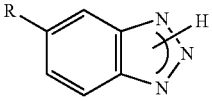

wherein the molar ratio of (Ia) to (Ib) is in a range of 10 to 60:90 to 40.

7. The method according to claim 1, wherein at least one further fuel additive is added to the fuel.

8. The method according to claim 1, wherein the frictional wear value (R) in μm is reduced by about 5 to 70% in comparison to the value determined before addition of the additive comprising a compound of the formula (I).

9. The method according to claim 1, wherein at least one further friction-reducing additive is added to the fuel.

10. The method according to claim 1, wherein the fuel composition is a gasoline fuel.

11. The method according to claim 1, wherein R is $C_2$ alkyl.

12. The method according to claim 1, wherein R is $C_3$ alkyl.

13. A process for preparing a fuel composition having improved frictional performance comprising adding a friction-reducing effective amount of a heterocyclic compound of the formula (I) to a fuel composition, (I)

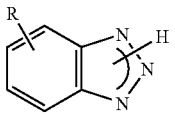

wherein R is $C_2$-$C_3$ alkyl.

14. The process according to claim 13, wherein R is $C_2$ alkyl.

15. The process according to claim 13, wherein R is $C_3$ alkyl.

* * * * *